United States Patent [19]

Hackell

[11] 3,952,447

[45] Apr. 27, 1976

[54] BUBBLE FORMING DEVICE

[76] Inventor: Walter Edward Hackell, 73 Alexander Ave., Napier, New Zealand

[22] Filed: Aug. 13, 1974

[21] Appl. No.: 497,054

[30] Foreign Application Priority Data

Aug. 16, 1973 New Zealand ..... 171710

[52] U.S. Cl. ..... 46/6

[51] Int. Cl.[2] ..... A63H 33/28

[58] Field of Search ..... 46/6–8

[56] References Cited

UNITED STATES PATENTS

| | | | |
|---|---|---|---|
| 216,176 | 6/1879 | Greenwalt | 46/6 |
| 294,728 | 3/1884 | Fickett | 46/7 |
| 1,576,287 | 3/1926 | Larsen | 46/6 |
| 2,274,052 | 2/1942 | Feder | 46/7 |

*Primary Examiner*—Louis G. Mancene
*Assistant Examiner*—Robert F. Cutting
*Attorney, Agent, or Firm*—Cushman, Darby & Cushman

[57] ABSTRACT

A bubble forming device is disclosed, wherein said device includes a bowl having an annular open topped chamber, and an air supply tube or pipe in open communication with the chamber to introduce air tangentially to the chamber axis. A disc is mounted on the bowl to cover the open top of the chamber, and to define a central opening which is in communication with the chamber. The disc and opening are concentric with the chamber and the bowl, and the outer face of the disc is provided with a series of slots which extend radially from the central opening.

The device may be used to form bubbles for amusement purposes, in an improved manner over the prior art bubble forming device.

20 Claims, 7 Drawing Figures

BUBBLE FORMING DEVICE

This invention relates to an improved bubble forming device, such a device being more particularly for amusement purposes.

The blowing of bubbles from a soap and water solution is well known and dates back many years to pipes having a bowl and a stem in which a soap and water solution was placed. These bubble blowing pipes were limited to blowing of bubbles of fairly small dimensions. It was soon discovered that to blow a bubble of large overall dimension, extra fluid needed to be added to the bubble surface as it grew. Such a device which goes some way to delivering this extra fluid is described in prior New Zealand patent specification No. 92171. This device was successful in forming large diameter bubbles, however it did have a number of draw-backs which restricted its use. These draw-backs also restricted the versatility of other large diameter bubble blowing devices.

While these previous devices were to a large extent successful in blowing large bubbles they were troubled with the problem of premature detachment of the bubble being blown. To overcome this problem the devices were modified to provide extra adhesion between the devices and the forming bubble. These modifications however, presented new problems in that it was difficult to release the formed bubble without puncturing it. These devices worked on the principle that extra fluid should be added to the bubble during formation to attain the large diameters, however, because the quantity of extra fluid being supplied could not be controlled the bubbles usually ended up being "wet". The term "wet" signifies a bubble having a drop of fluid in the bottom, this drop of fluid being the excess not used to form the bubble. This excess drop of fluid presents problems in that the bubble sinks quickly after being released from the device and the drop of fluid in the bottom of the bubble will cause it to join onto a second bubble introduced underneath as it descends. This makes the maintaining aloft of one or more large diameter bubbles by striking them underneath with a hemispherical bubble which has been formed immediately after the release of the former bubble or bubbles difficult if not impossible.

The aim of the present invention is to provide an improved bubble forming device whereby large diameter bubbles can be blown which are not prone to premature release from the device and by virtue of the construction of the device are easy to remove.

A further aim of the invention is to provide a bubble forming device which can be used to form long chains of large diameter bubbles.

A still further aim of the invention is to provide a bubble blowing device for the blowing of large diameter bubbles wherein the amount of bubble forming fluid being supplied to the bubble being formed can be controlled.

Broadly the invention consists of a bubble forming device comprising a body having an annular open topped chamber, an air supply tube or pipe the bore of which is in communication with the said chamber and is so positioned that air passing therethrough enters the annular chamber tangentially to the axis thereof, a disc mounted on said bowl covering the open top of the chamber and having a central opening in communication with said chamber, the disc and opening being concentric with said chamber and the outer face of the disc is provided with a series of slots extending radially from the central opening.

In the following more detailed description of the invention, reference will be made to the accompanying drawings in which.

Figure 1:
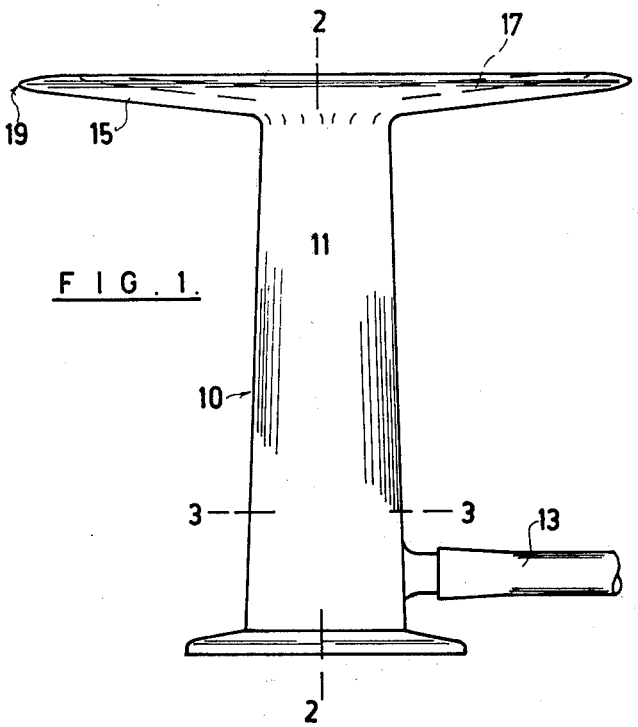
FIG. 1 is an elevational view of one form of the invention.
Figure 2:
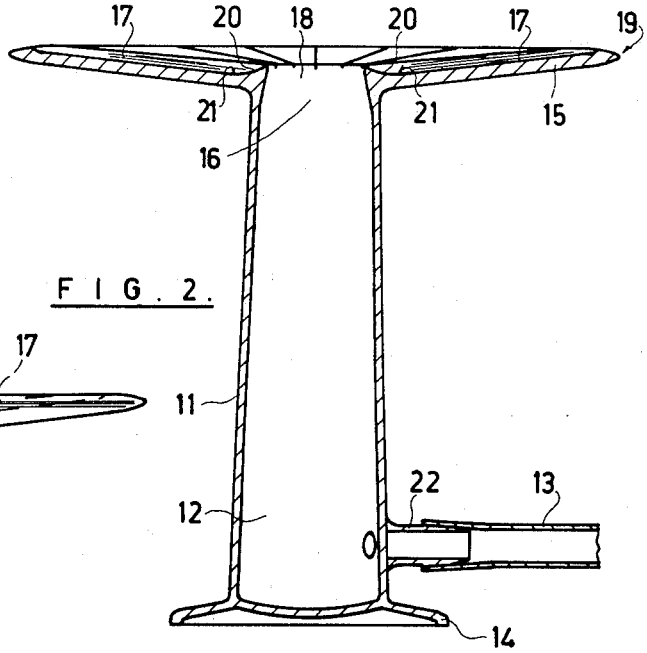
FIG. 2 is a cross-sectional view on 2—2 of the form shown in FIG. 1.
Figure 4:
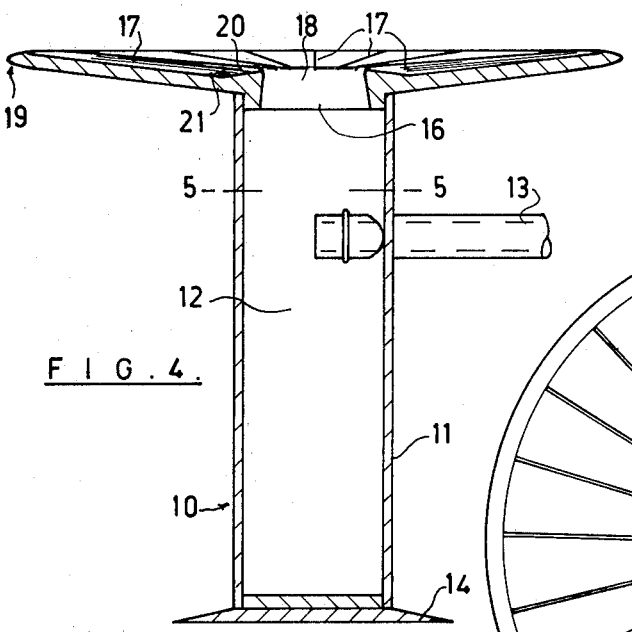
FIG. 4 is a cross-sectional elevational view of a second form of the invention.
Figure 6:
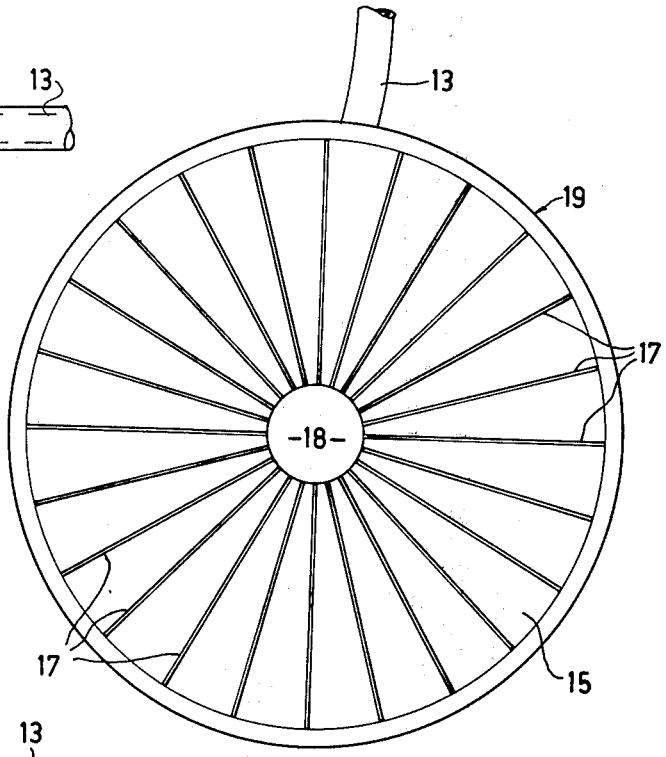
FIG. 6 is a plan view of either forms of the invention.

In more fully describing the invention as a preferred embodiment the device is preferably constructed from a plastics material, however, if desired other material could be used. The body 10 is of one piece construction as shown in FIGS. 1, 2 and 4 is preferably in the form of an elongate handle 11 having the annular chamber 12 formed therein. In the drawings the chamber 12 is shown as extending the length of the handle 11 but this is not necessary as in the case of the embodiment shown in FIG. 4 the annular chamber 12 could stop at a point below the point of entry of the tube or pipe 13 leaving the lower part of the handle of solid construction. The length of the handle 11 is such that the device can sit steadily on a flat surface and to assist a base portion 14 is provided. The handle can be shaped to provide finger grips if required.

Figure 5:
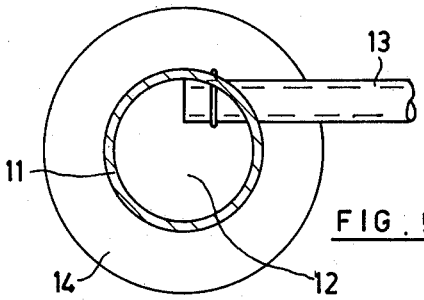
FIG. 5 is a cross-sectional view on 5—5 of FIG. 4.

The body 10 and the disc 15 can be constructed as one piece (see FIG. 2) or it can be of two piece construction, FIGS. 4 and 5. In either form of the invention, however, the chamber 12 is open at its upper end through a tapered throat 16. The throat 16 tapers to its narrowest area at the top. As can be seen in the drawings the major part of the throat 16 is contained in the thickness of the disc construction.

The disc 15 has a series of slots 17 extending radially from the central opening 18 of the disc, i.e. the opening formed by the throat 16. The edges of the central opening 18 are slightly rounded as this gives good results but more importantly allows for easier moulding of the device when made from a plastics material. The slots 17 extend from said rounded edges of the opening 18 to terminate short of the outer peripheral edge 19 of the disc. The outer peripheral edge 19 is of a semi-elliptical shape.

The upper surface of the disc 15 is dished inwardly to the central opening 18 and accordingly the slots 17 slope down toward the central opening 18. Just prior to reaching the central opening 18 the bottom of the slot 17 is curved upwardly as at 20 so that the depth of the end of the slot 17 communicating with the opening 18 is not as great as would have been the case had the slot sloped directly into the said opening. A low point 21 is thus formed in the length of each slot 17. The number of radial slots 17 is not greatly important but for a disc of 14 cm diameter, twenty-four evenly spaced apart slots appear to give the best results.

The tube or pipe 13 can enter directly through the body 10 to communicate with chamber 12 (see FIG. 4), however as shown in FIG. 2 the tube or pipe 13 is connected to a hollow spigot 22 moulded in the handle 11. In this arrangement the tube or pipe 13 can be a push fit on the spigot 22. In either form the entry end of the pipe or tube 13 is set tangentially to the axis of the chamber 12. As seen in FIG. 5 the pipe enters hard against the inside wall of the chamber 12 but in FIG. 3 it enters tangentially to an imaginary circle concentric with the chamber axis (shown dotted) and of less diameter than that of the inside wall of the chamber 12. The reason for the different choice of entry will become apparent from the following disclosure.

The tube or pipe 13 is of a convenient length to allow a person to hold onto the handle 11 and manipulate the device without the necessity to remove the tube. A mouth piece (not shown) can be provided if required.

In use the device is inverted so that the disc 15 is lowermost and the outer or dished surface of the disc is placed so that it touches the surface of a bubble blowing fluid contained in an open mouthed container, for example a shallow plate. The bubble forming solution is of conventional composition being made of water and soap or detergent. The device is then lifted clear and by blowing through the tube or pipe 13 the bubble starts to form on the outer face of the disc 15. When the bubble is about half the required diameter the device is turned upright and the bubble is then blown to its full size. Large bubbles can also be blown with the device upright all the time as long as the disc has been completely wetted first.

Figure 7:
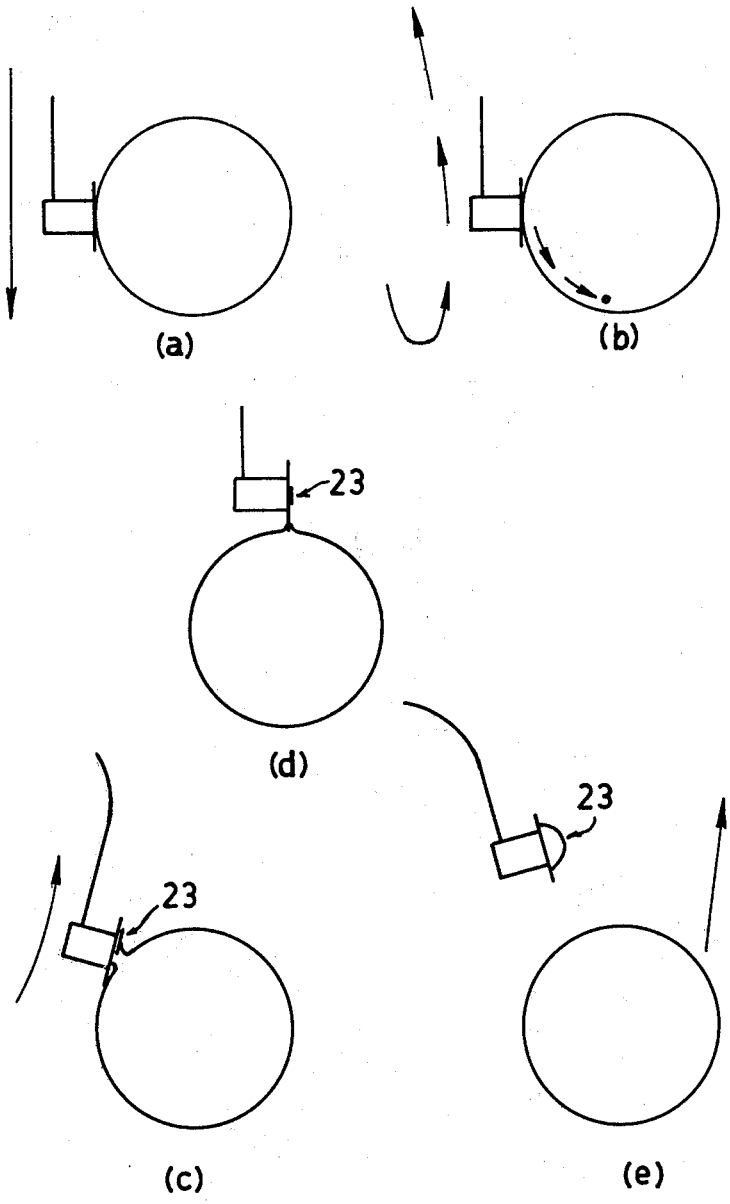
FIG. 7 is a diagramatical series of representations showing the removal of a finished bubble from the device.

To remove the bubble from the disc the device is held in the hand by the handle and turned on its side and moved in a downward direction for a distance and then drawn upwardly. During this movement the bubble slides across the disc 15 and detaches itself therefrom at the same time drawing a film of the bubble forming fluid across the disc face thus preparing the disc face for the blowing of a further bubble. This operation is shown diagramatically in FIG. 7 where (a) shows the initial downward stroke, (b) the upward stroke followed by (c) and (d) showing the bubble moving off the disc and drawing a new film (indicated at 23) across the central opening 18 and finally at (e) the bubble floats free and the second bubble starts automatically. A number of separate bubbles can be blown in this manner before the fluid on the disc is consumed and the device is then once more placed in the bubble forming solution ready for the blowing of a further succession of bubbles.

The slotted disc 15 thus retains a supply of bubble forming solution after the disc has been lifted from the surface of the said solution. The film of solution is held on the discs smooth by surface tension and an additional supply is held in the slots 17 by capillary action. On blowing through the tube or pipe 13 a hemisphere of film appears and as it increases in diameter fluid drains from the surface of the disc and/or the slots on to the entire surface of the hemisphere. This ensures that the film is maintained at its maximum thickness for as long as possible so making practicable, large diameter bubbles. The extra fluid from the slots 17 also allows the continuous succession of bubbles. Also this supply of fluid is not lost or split when the device is manoeuvred as is the case with previous devices.

The surface of the disc is slightly coned as described so as to encourage the excess moisture at the outer periphery of the disc to flow toward the central opening where it is required for forming new or adding to developing bubbles. The new film over the central opening is thus more certain to grow into the next bubble if it is moistened by this extra supply of fluid. In this respect the upwardly curving ends of the slots assist as they ensure that the supply of excess fluid does not pass into the central opening.

In addition the coned disc is capable of holding a larger supply of fluid when the disc is held in the upright position than a flat disc. It also provides a layer of liquid on which the bubble can easily slide.

When the disc is turned on its edge to remove the bubble formed thereon the last area of contact of the formed bubble with the disc is the elliptical peripheral edge 19 of the disc. This last contact is of small area and thus the bubble is easily detached from the disc without being punctured as the film is allowed to travel around onto the other side of the disc without breaking away from the edge while the film on the other side of the bubble catches up.

The tangential entry of the air into the annular chamber is important as it provides a swirling motion to the air entering the forming bubble. In addition the swirling motion ensures that a controlled air flow into the bubble is achieved and causes the forming bubble to spin which has been found to be beneficial.

A smooth flow and volume of air into the bubble is thus achieved without the film across the central opening being destroyed or distorted during the initial stages of forming the bubble. The flow set up by the chamber further ensures that a more even distribution of fluid adding to the forming bubble is realised, thus providing a uniform thickness of film. The chamber by setting up the back pressure discourages the user from blowing too hard and so breaking the bubble.

Figure 3:
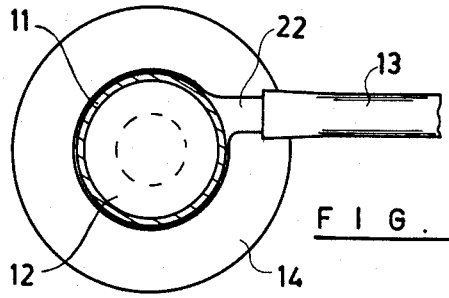
FIG. 3 is a cross-sectional view on 3—3 of FIG. 1.

Regarding the tangential entry of the air supply into the chamber the entry can be tangential to the inner wall of the chamber as shown in FIG. 5 or tangential to a circle of diameter less than the chamber wall as shown in FIG. 3. The arrangement in FIG. 3 is normally employed to reduce the speed of rotation of the bubble when forming as it has been discovered that a high rotational speed results in a bubble distorted in shape. Accordingly, while the air supply entry is always tangential it does not need to be tangential to the actual inner wall surface of the chamber.

The tapered throat assists in the positioning of the film across the central opening. Ideally the film sits just below the bottom of the slots where they enter the opening. As most young children appear to breathe in slightly before they begin to blow this allows the film to be sucked down slightly while remaining in the throat and thus is not destroyed. The throat also prevents the new film over the central hole from moving down into the annular chamber or handle of the device.

The present invention thus provides a bubble blowing device whereby large diameter bubbles can be blown. The slotted disc construction because of its relatively large diameter ensures that there is no premature detachment of the forming bubble as it provides a cohesive force in the "neck region" of the bubble sufficient to support a large bubble or chain of large bubbles but which also permits easy removal without puncture of formed bubbles. The amount of bubble forming solution entering into the forming bubble is uniform due to the annular chamber with tangential air entry. The amount of solution entering from the reservoir can also be controlled when the device is in its inverted position. When in the inverted position with the disc horizontally disposed the solution is held in the slots by capillary action and so little or no solution flows therefrom into the bubble. If the disc is however, tilted, the fluid runs lengthwise down the slots and into the bubble, therefore, tilting of the disc can control the amount of solution entering the forming bubble.

A long chain of bubbles can be formed by the use of this device. A bubble is formed in the aforementioned manner and after detachment from the device it floats upwardly. A second bubble is then formed and connected to the first formed bubble. The second bubble is then caused to move across the central opening in the disc so establishing a new film for the third bubble in the chain. However the second bubble is at no stage completely released from the disc until the film across the central opening is attached to it by sliding the peripheral edge of the second bubble back across part of the newly established film which is across the central opening but has not been as yet blown into a bubble. The third bubble is now blown which slowly displaces the second bubble completely off the disc. This process is repeated to form a large chain of bubbles. The final formed bubble is then released from the disc in the manner described for single bubbles thus forming a large floating chain of bubbles.

The necessary movements of the bubbles across the disc requires some skill with arm movements and a second and easier method of blowing a bubble chain is by using a base to which the lowest bubble in the chain is attached so as to hold the column or chain of bubbles steady as the device at the top of the column forms each successive bubble in the manner described previously. The column of bubbles can be released from the base by puncturing the bubble at the base of the column. The chain can then be lifted clear of the base and released from the device in the manner described for single large diameter bubbles.

A long hanging chain of bubbles can be formed using two of the devices, one device being at each end of the chain as it forms. Alternatively, one device can be used and the bubbles formed with attachment to at their lower end to a disc or plate.

Dry bubbles (i.e. bubbles having no drop of solution in the bottom) can be blown by the device. The bubble is formed with the slotted disc uppermost so that excess solution drains from the inside of the bubble on to the disc. To remove the bubble from the disc the device is moved sideways in one direction (instead of up and down) and then not too quickly moved back in the opposite direction causing the bubble to slide from the disc. The bubble at the point of release drains any excess moisture into the slot ready for the next bubble to be blown.

The above details only a few of the many varying types of bubbles and bubble structures which can be blown by the device and are thus by way of example only to illustrate the versitility of the device. Accordingly, many of the problems associated with the blowing of large diameter bubbles and bubble structures inherent in earlier types of bubble blowing devices have been overcome.

What is claimed is:

1. A bubble forming device comprising a body having an annular open topped chamber, an air supply tube or pipe the bore of which is in communication with the said chamber and is so positioned that air passing therethrough enters the annular chamber tangentially to the axis thereof, a disc mounted on said body covering the open top of the chamber and having a central opening in communication with said chamber, the disc and opening being concentric with said chamber and the outer face of the disc is provided with a series of slots extending radially from the central opening.

2. The device according to claim 1 wherein the opening is in the form of a tapered throat extending downwardly from the upper surface of the disc into the chamber, said throat tapering outwardly into the said chamber.

3. The device according to claim 2 wherein the upper surface of the disc is dished inwardly to the central opening.

4. The device according to claim 3 wherein the slots slope in toward the central opening parallel with the slope of the upper surface of the disc, said slots however curving upwardly near the central opening to enter said central opening at its outer end.

5. The device according to claim 1 wherein the outer peripheral edge of said disc is of a semi-elliptical cross-sectional shape.

6. The device according to claim 5 wherein the upper edge of the throat forming the central opening is rounded, said slots radiating from said rounded edge to terminate short of the semi-elliptically shaped outer peripheral edge of the disc.

7. The device according to claim 1 wherein the bore of the air supply tube or pipe is set tangentially to the inner wall of the annular chamber.

8. The device according to claim 1 wherein the bore of the air supply tube or pipe is set tangentially to a circle concentric with the chamber axis and of less diameter than the inside wall of the said chamber.

9. The device according to claim 8 wherein a hollow spigot formed on the body and in communication with the chamber forms the entry for the air supply from the tube or pipe, said tube or pipe being of a flexible nature and fitted to the outer end of said hollow spigot.

10. The device according to claim 1 wherein the body is in the form of a handle and both the body and disc are constructed from a plastics material.

11. A bubble forming device comprising a body having an annular open topped chamber, an air supply tube or pipe the bore of which is in communication with the said chamber and is so positioned that air passing therethrough enters the annular chamber tangentially to the axis thereof, a disc mounted on said body covering the open top of the chamber and having a central opening in communication with said chamber, the disc and opening being concentric with said chamber and the greater part of the area of the upper surface of the disc dished inwardly to the central opening.

12. The device according to claim 11 wherein the opening is in the form of a tapered throat extending downwardly from the upper surface of the disc into the chamber, said throat tapering outwardly into the said chamber.

13. The device of claim 12 wherein the upper surface of the disc is provided with a series of slots extending radially from the central opening.

14. The device according to claim 13 wherein the slots slope in toward the central opening parallel with the slope of the upper surface of the disc, said slots however curving upwardly near the central opening to enter said central opening at its outer end.

15. The device according to claim 11 wherein the outer peripheral edge of the disc is of a semi-elliptical cross-sectional shape.

16. The device according to claim 15 wherein the upper edge of the throat forming the central opening is rounded, said slots radiating from said rounded edge to terminate short of the semi-elliptically shaped outer peripheral edge of the disc.

17. The device according to claim 11 wherein the bore of the air supply tube or pipe is set tangentially to the inner wall of the annular chamber.

18. The device according to claim 11 wherein the bore of the air supply tube or pipe is set tangentially to a circle concentric with the chamber axis and of less diameter than the inside wall of the said chamber.

19. The device according to claim 18 wherein a hollow spigot formed on the body and in communication with the chamber forms the entry for the air supply from the tube or pipe, said tube or pipe being of a flexible nature and fitted to the outer end of said hollow spigot.

20. The device according to claim 11 wherein the body is in the form of a handle and both the body and disc are constructed from a plastics material.

* * * * *